United States Patent [19]

DeForrest, Sr.

[11] Patent Number: 4,798,069

[45] Date of Patent: Jan. 17, 1989

[54] PROTECTING DEVICE FOR LEVER HANDLE DOOR LOCKS

[76] Inventor: William DeForrest, Sr., 1825 Via Burton, Anaheim, Calif. 92806

[21] Appl. No.: 145,387

[22] Filed: Jan. 19, 1988

[51] Int. Cl.[4] ..... E05B 17/14

[52] U.S. Cl. ..... 70/428; 70/424; 70/211

[58] Field of Search ..... 70/428, 455, 211, 423, 70/424, 425, 426, 427, 207, 209, 210

[56] References Cited

U.S. PATENT DOCUMENTS

| | | | |
|---|---|---|---|
| 2,070,955 | 2/1937 | Parisoe | 70/455 |
| 3,245,240 | 4/1966 | DeForrest | 70/209 |
| 4,134,279 | 1/1979 | Ross | 70/424 |
| 4,372,138 | 2/1983 | DeForrest | 70/56 |
| 4,463,584 | 8/1984 | DeForrest | 70/428 |

*Primary Examiner*—Robert L. Wolfe

*Attorney, Agent, or Firm*—Herb Boswell

[57] ABSTRACT

A protection device useful for preventing access to a cylinder key lock on a lever handle handle door lock incorporates a first and second half which are joined together along a junction to form a united body. The united body has a closed bottom wall and a substantially circular circumferential wall as well as a top wall. Locking means are adapted to the body to secure the first and second halves together. The top wall includes an opening partially formed in one of the halves and formed in further in the other half. The opening is sized and shaped to fit around the shank portion of a lever handle door lock. The device further includes a rectangular opening in the circular circumferential wall which is located such that its elongated dimension is essentially parallel to the top wall. The protection device is fit over a lever handle door lock by inserting the lever portion of the lever handle door lock through the rectangular opening and positioning the opening in the top wall around the shank of the lever handle door lock to position the cylinder lock of the door lock within the united body of the protection device.

2 Claims, 2 Drawing Sheets

PROTECTING DEVICE FOR LEVER HANDLE DOOR LOCKS

BACKGROUND OF THE INVENTION

This invention is directed to a protecting device capable of encasing the locking device of a lever handle door lock to prevent access to the locking device in the lever handle door lock.

In my prior U.S. Pat. Nos. 3,245,240, 4,473,138 and 4,463,584 I respectively disclose protecting devices which are useful for the prevention of ingress and egress to a door having a door knob with a lock integral with the door knob, a protecting device for preventing access to the cylinder lock portion of the padlock and a protecting device for storing keys and the like which fit other locks.

The device disclosed in my U.S. Pat. No. 3,245,240 is very utilitarian in preventing the locking or unlocking of a door knob of the type which incorporates a lock on the door knob. The device disclosed in my U.S. Pat. No. 4,372,138 is very utilitarian in preventing access to the cylinder lock of a padlock or a combination type padlock. Further, the device described and claimed in my U.S. Pat. No. 4,463,584 is very utilitarian in providing a receptacle for storing keys which fit other locks as, for instance, car locks and the like while allowing the use of a single master key to have access to a variety of these storage devices.

While the above protection devices all have utility with respect to particular types of locks, none are usable in association with a lever type door lock. In commercial buildings lever type door locks are increasingly being used. They offer the advantages of being architecturally pleasing as well as providing a secure place for a user of a door to grip while rotating the handle to unlock the door and to pull or push the door to move the door.

In many situations it is desirable to temporarily deny access to the cylinder lock in a common lever handle door lock. By denying access to the cylinder lock, holders of the keys to the cylinder lock are denied access to locking or unlocking the door.

BRIEF SUMMARY OF THE INVENTION

In view of the above there exists a need for new and improved protection devices which are capable of being utilized on lever handle door locks to deny access to the cylinder or other type locks in those lever handle door locks. It is therefore a broad object of this invention to provide for such protection devices. It is a further object of this invention to provide for a protection device which is related to prior known protection devices such that certain component parts of the prior known protection devices can be utilized in the construction of the protection device for lever handle door locks.

These and other objects as will become evident from the remainder of this specification are achieved in an improvement in a protection device of the type having first and second protector halves hingedly associated with each other. The first and said second halves join together along a substantially planar junction and the halves when associated together along this planar junction substantially form a hollow united body. The united body has a closed bottom wall and a substantially cylindrical circumferential wall. The body further has a top wall and locking means adapted to releasably secure the first and the second halves together to maintain the first and the second halves as a unified united body. The locking means includes first and second lugs respectively secured to the first and the second halves on the circumferential wall. The improvement includes forming an opening in the top wall into the interior of the united body. The opening is formed in the first and the second halves such that a portion of the opening is located in one of the first or the second halves and the remaining portion of the opening is located in the other of the first or the second halves. Together the portions form a singular opening in the top wall when the halves are associated together along the planar junction to form the unified body. Further a rectangular opening is formed in the circumferential wall with the elongated dimension of the rectangular opening located parallel to the top wall. The rectangular opening is sized and shaped to accept the lever portion of a lever handle door lock and the opening in the top wall is sized and shaped to accept the shank portion of the lever handle door lock. The protection device is secured on the lever handle door lock by inserting the lever handle through the rectangular opening and positioning the opening in the portions of the top wall around the shank portion of the lever handle door lock followed by securing of the first and second halves of the protection devices together to prevent access to a cylindrical lock or other lock located in the lever handle door lock shank portion.

BRIEF DESCRIPTION OF THE DRAWINGS

This invention will be better understood when taken in conjunction with the drawings wherein.

This invention utilizes certain principles and/or concepts as are set forth in the claims appended hereto. Those skilled in the locksmithing arts will realize that these principles and/or concepts are capable of being utilized in a variety of embodiments which may differ from the exact embodiment utilized for illustrative purposes herein. For this reason this invention is not to be construed as being limited solely to the illustrative embodiment but, should only be construed in view of the claims.

DETAILED DESCRIPTION OF THE INVENTION

Certain aspects of this invention are similar to aspects incorporated in my U.S. Pat. Nos. 3,245,240, 4,372,138 and 4,463,584. In the interest of brevity, those aspects of the invention described in my prior patents will not be elaborated in detail in this specification. For construction details of those aspects which find counterparts in my above referred to prior patents reference is made to those patents and as such they are specifically herein incorporated by reference.

Figure 2:
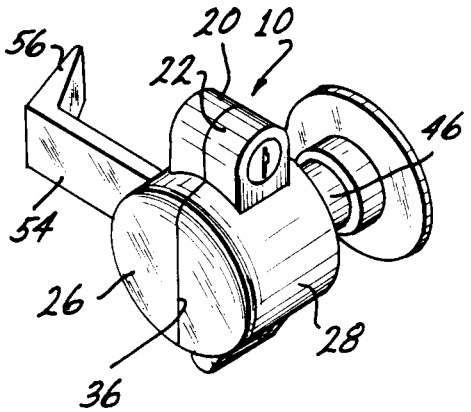
FIG. 2 is an isometric view similar to FIG. 1 showing the protection device locked around the cylinder lock of a lever handle door lock of FIG. 1.
Figure 5:
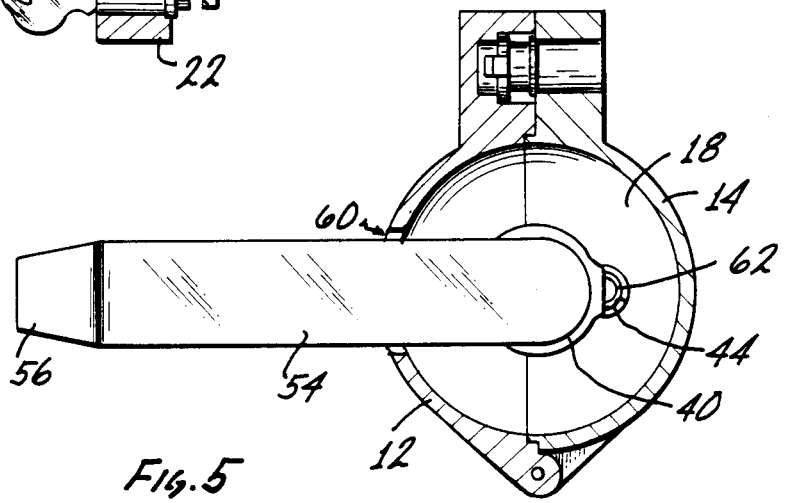
FIG. 5 is a front elevational view in partial section of a lever device of the invention shown in an orientation similar to that seen in FIG. 2.

A protection device 10 of this invention is composed of a first half 12 and a second half 14. The first and second halves 12 and 14 are hinged together about a hinge 16 such that they can be joined together to form a unified body. Each of the first and second halves 12 and 14 are essentially hemicylindrical in shape and thus when they are associated together as depicted in FIG. 2 and 5 they form a hollow body having an interior 18. Lugs 20 and 22 are appropriately formed on the first and second halves 12 and 14 respectively. They serve as an attaching and receiving clamp for a lock assembly 24 as is essentially identified and disclosed in my U.S. Pat. No. 3,245,240.

The protection device 10 has a bottom wall 26, a circumferentially extending side wall 28 and a top wall 30. One half of each of the walls 26, 28 and 30 is located on the first half 12 with the other half of the walls 26, 28 and 30 located on the second half 14. Together the walls 26, 28 and 30 are capable of completely enclosing the interior 18 of the protection device 10 when the first and second halves 12 and 14 are brought together.

Figure 1:
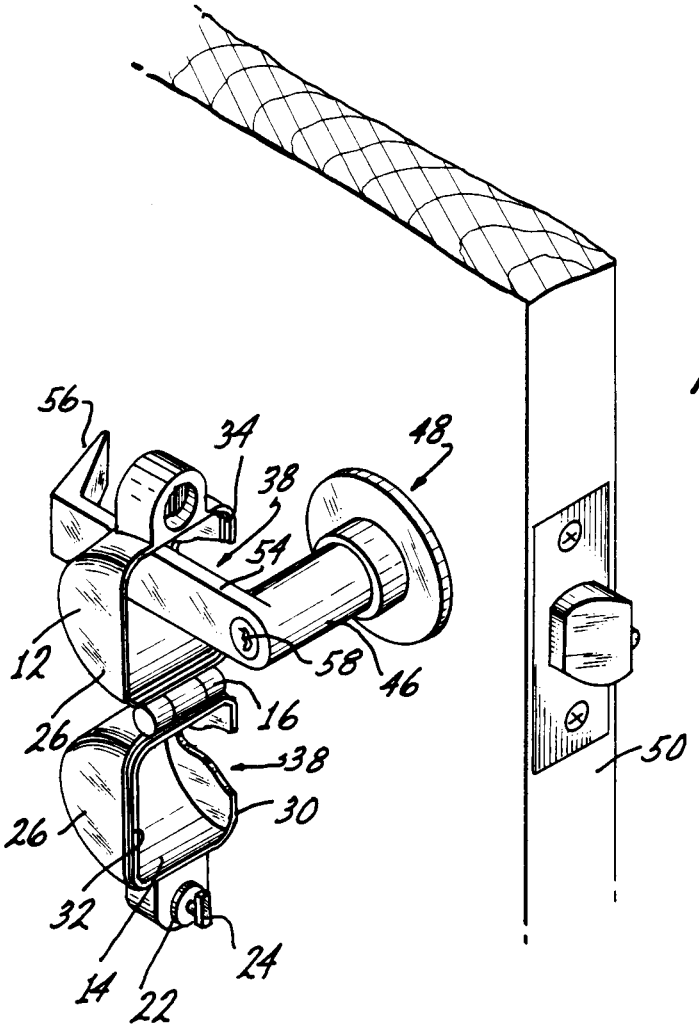
FIG. 1 is an isometric view of a protection device of the invention in an unlocked orientation showing positioning of the protection device of the invention on a lever handle type door lock which is located in association with a door.

When the first and second halves 12 and 14 of the protection device are pivoted about the hinge 16, the protection device 10 is opened as is seen in FIG. 1 exposing the interior 18 of the protection device 10. A tongue 32 is located about the periphery of the second half 14 and a groove 34 is located around the periphery of the first half 12. This periphery forms a planar junction 36 between the two halves 12 and 14 with the tongue 32 locking into the groove 34. When the protection device 10 is put into a closed position as seen in FIG. 2 the tongue 32 and groove 34 prevents wedging of a screwdriver or other device between the first and second halves 12 and 14 in an attempt to separate them from each other.

Figure 4:
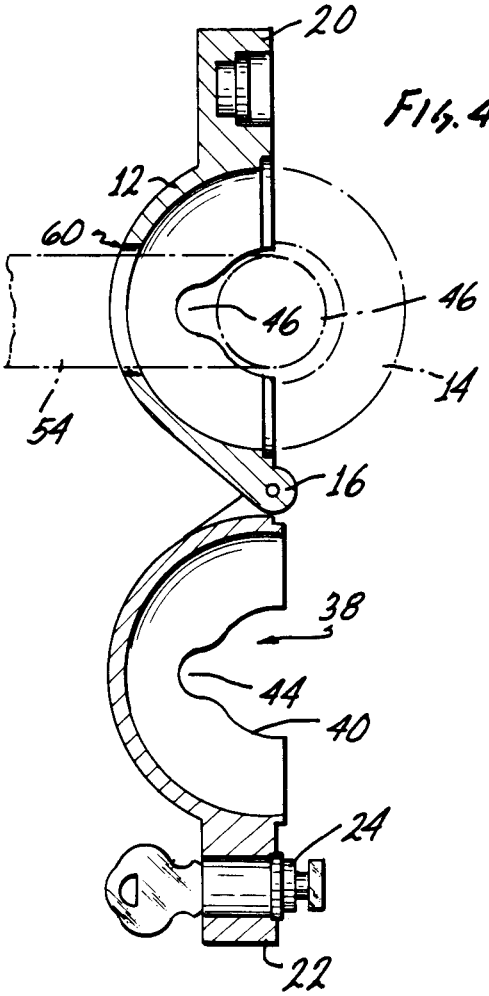
FIG. 4 is a front elevational view in partial section of the protection device of the invention shown in an orientation corresponding to the orientation shown in FIG. 1.

An opening 38 is formed in the top wall 30. The opening 38, as is best seen in FIG. 4, has a circular portion 40 and left and right extending elongations 42 and 44 of the opening 38 in the first and second halves 12 and 14 respectively. The circular portion 40 of the opening 38 allows the halves of the top wall 30 to fit around a circular shank portion 46 of a lever handle door lock 48.

As can be seen in the figures, when the lever handle door lock 48 is located on a door 50, the circular shank portion 46 extends perpendicularly from the surface 52 of the door 50. The lever handle door lock 48 further includes a lever portion 54 which extends essentially parallel to the surface 52 of the door 50 except for a tip area 56 which extends back toward the surface 52 of the door 50. A common cylinder lock 58 is normally located in the shank 46 of the lever handle door lock 48. Normally the lever handle door lock 48 can be locked by rotating a key in the cylinder lock 58. When so locked rotation of the lever 54 of the door lock 48 is prevented and the door 50 cannot be opened. When the lock 58 is unlocked the lever 54 can be rotated to open the door 50.

Figure 3:
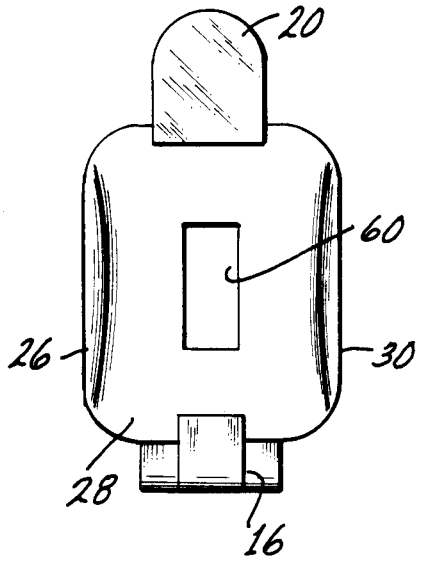
FIG. 3 is a side elevational view of the protection device of the invention.

The protection device 10 of the invention further includes a rectangular opening 60 best seen in FIG. 3 which is formed in the circumferentially extending side wall 28 centered between the hinge 16 and the lug 20 on the first half 12. The elongated dimension of the rectangular opening 60 is parallel to both the top and bottom walls 26 and 28. This allows insertion of the tip 56 of the lever 54 followed by the lever 54 itself through the rectangular opening 60 to position the first half 12 on the lever handle door lock 48 as is seen in FIG. 4. When so positioned the second half 14 can now be rotated about the hinge 16 and locked to the first half 12 as is seen in FIGS. 2 and 5.

With the protection device 10 located over the lever handle door lock 48, as is seen in FIGS. 2 and 5, access to the cylinder lock 58 of the lever handle door lock is prevented and thus either the lever handle door lock 48 cannot be locked if it is in an unlocked orientation or it cannot be unlocked if it is in a locked orientation.

If it is desirous to prevent unlocking of the cylinder lock 48, the protection device 10 is secured over the lever handle door lock when the cylinder lock 58 is in the locked orientation. This is easily done by simply sliding the first half 12 of the lever 54 and securing the second half 14 to the first half 12 as described. When so locked the lever 54 will not activate the door mechanism and the door 50 will remain locked.

Other times it is desirous to maintain the cylinder lock 58 of the lever handle door lock 48 in an unlocked orientation to prevent locking of the door 50. When the cylinder lock 58 is unlocked and the protection device 10 is secured over the lever handle door lock 48, as is seen in FIG. 2, the door 50 can still be opened and closed because of the extension of the lever portion 54 of the lever handle door lock 48 out of the rectangular opening 60 of the protection device 10 which allows for operation of the lever handle door lock 48 to open the door 50. It is thus evident that the protection device 10 can be utilized to both lock the door 50 in a locked orientation or to maintain the door 50 in an unlocked orientation.

Certain lever handle door locks 48 which are located on the interior of a door may not be equipped with a cylinder lock 58 but may be equipped with a thumb lock which can be easily rotated. If it is desirous to prevent unauthorized locking of the door from the interior as, for instance, by unwatched children or the like the protection device 10 can be located over the lever handle door lock to prevent access to such a thumb activated locking mechanism on an interior lever handle door lock 48.

Certain lever handle door locks include projections located on their shanks. Such a projection, projection 62 is shown on the lock 48 of FIG. 5. The projection 62 is accommodated by one of the opening extensions 42 or 44 as, for instance, extension opening 44 seen in FIG. 5.

I claim:

1. In a protection device of the type having first and second protector halves hingedly associated with each other, said first and said second halves joining together along a substantially planar junction, said halves when associated together along said planar junction substantially forming a hollow united body, said united body having a closed bottom wall and a substantially cylindrical circumferential wall, said body having a top wall, locking means adapted to releasably secure said first and said second halves together maintaining said first and said second halves as a united body, said locking means including first and second lugs respectively secured to said first and said second halves on said circumferential wall the improvement consisting of:

said top wall including an opening opening into the hollow interior of said united body, said opening formed in said first and said second halves such that a portion of said opening is located in one of said first or said second halves and the remaining portion of said opening is located in the other of said first or said second halves and together said portions form a singular opening in said top wall when said halves are associated together along said planar junction to form said united body;

said opening sized and shaped to receive an outwardly extending shank of a lever handle door lock, said shank portion including a cylindrical lock located therein;

said circumferential wall including an elongated rectangular opening into the hollow interior of said body, the elongated dimension of said rectangular opening located essentially parallel to said top wall;

said rectangular opening sized and shaped so as to accept the lever portion of a lever handle door lock;

said protection device fitting over said lever handle door lock by passing said handle portion of said lever handle door lock through said rectangular hole and positioning said opening in said top wall of said protection device around the shank of said lever handle door lock whereby when said halves of said protection device are associated together to form a united body the shank portion of said lever handle door lock including said cylinder lock located therein are located within the interior of said body with a portion of said lever section of said lever handle door lock extending from the interior of said body through said rectangular opening to the exterior of said body.

2. The protection device of claim 1 wherein:

said opening in said top wall is formed to include a central circular portion having right and left extensions on said central circular portion, said right and left extensions adapted to receive projections on circular lever handle door lock shanks.

* * * * *